US006981817B2

(12) United States Patent
Braverman

(10) Patent No.: US 6,981,817 B2
(45) Date of Patent: Jan. 3, 2006

(54) BASE UNIT FOR ROAD DELINEATING DEVICES

(76) Inventor: Josef J. Braverman, 32 Lorna Vista Drive, Thornhill, Ontario (CA) L5J 7S3

( * ) Notice: Subject to any disclaimer, the term of this patent is extended or adjusted under 35 U.S.C. 154(b) by 210 days.

(21) Appl. No.: 10/620,454

(22) Filed: Jul. 17, 2003

(65) Prior Publication Data

US 2005/0012083 A1 Jan. 20, 2005

(51) Int. Cl.
*G09F 15/00* (2006.01)

(52) U.S. Cl. ..... 404/9; 116/63 P; 116/63 C; 40/606.01

(58) Field of Classification Search ..... 404/6, 404/9; 116/63 P, 63 C; 40/606.01
See application file for complete search history.

(56) References Cited

U.S. PATENT DOCUMENTS 5,215,399 A * 6/1993 Berger ..... 404/6
5,560,732 A * 10/1996 Kulp et al. ..... 404/10
5,613,798 A 3/1997 Braverman
5,722,788 A * 3/1998 Bent et al. ..... 404/6
5,735,632 A * 4/1998 Braverman ..... 404/6
5,983,602 A * 11/1999 Allen et al. ..... 53/445
6,182,600 B1 * 2/2001 Brown et al. ..... 116/63 C
6,386,135 B1 * 5/2002 Oshima ..... 116/63 C
6,817,805 B2 * 11/2004 Mettler et al. ..... 404/6

* cited by examiner

*Primary Examiner*—Gary S. Hartmann
(74) *Attorney, Agent, or Firm*—R. Craig Armstrong; Borden Ladner Gervais LLP

(57) ABSTRACT

A base unit and a delineating device for delineating traffic. The traffic delineating device comprises a base unit and a body unit extending upwardly via a first aperture in the base unit. The base unit comprises a first surface having the first aperture and a second surface having a second aperture, and the surfaces are joined together around a substantial section of their perimeters via a side wall, and the side wall together with the first surface and the second surface limits and defines an interior sleeve of the base unit. The side wall has an opening for inserting ballast between the first and second surfaces into the sleeve, and the sleeve is of suitable size and shape to hold the ballast. The ballast consists normally of tread from vehicle tires. Preferably, at least one of the first and second surfaces comprises a non-rounded portion, thereby preventing the base unit from rolling. The base unit can be easily assembled by local distributors utilizing local recyclables. The invention further provides flexibility in functional design, since the invention can match different shapes and sizes of a body unit of the device.

13 Claims, 6 Drawing Sheets

BASE UNIT FOR ROAD DELINEATING DEVICES

FIELD OF THE INVENTION

The present invention relates generally to traffic delineating devices and more specifically to a base unit for traffic delineating devices.

BACKGROUND OF THE INVENTION

Some currently known and used bases for channelizing and delineating traffic devices have a base unit made solely out of used tires. These base units have the advantage of recycling parts of used tires. However, they have limitations in size. Bases made of truck tire side walls require a large space, such space is frequently not safely available in situations that require the use of delineating traffic devices. In addition they are not quite friendly in handling due to large size. Existing devices using stacked car side walls have the propensity to roll if knocked over, potentially creating a serious hazard to traffic. Besides, when a number of side walls are stacked to achieve increased stability, the safety requirement that the base be separable from the body in high impact is jeopardized.

Another prior art base unit consists of a plastic container filled with bulk or liquid ballast. This kind of base unit does not have the above mentioned disadvantages, but it requires filling with ballast, which involves a messy procedure, which is desirable to avoid. Devices using sand as ballast suffer from the further disadvantage of loss of sand in the event of breakage of the base unit.

A third type of prior art base unit only consisting of the pressed crumbles of recycled rubber has also been used. This kind of base avoids some of the above-mentioned limitations since it is practical, aesthetic and ergonomic. However, manufacture of this unit is quite costly. These bases are made of recycled, but not local raw material, thus adding high distribution cost to already higher production cost.

All above-mentioned devices suffer from being cumbersome due to absence of handy handle in the base.

U.S. Pat. No. 5,613,798 (Braverman) describes a base for a traffic control device, which utilizes all parts of a recycled tire, thus not just the side walls. The base has a handle and an anti-roll feature, but still is limited (in lesser degree) in application by size of tires available in postindustrial marketplace, and it lacks an appealing appearance.

SUMMARY OF THE INVENTION

It is therefore desirable to provide a user-friendly base unit, that has an anti-rolling feature and an ergonomic handle for moving the whole device; a unit that utilizes local recyclables; a unit that can be easily assembled by local dealer; a unit whose function and aesthetic appearance is independent of the skills and experience of the assembler.

It is also desirable to provide a base unit, which is easily installed, easily removed and easily transported, involving only low production and distribution costs, which also includes anti-rolling features and requires only a very limited transportation space.

Another advantage with the present invention is that since the base unit can partly be assembled at the location of use using local recyclables by local distributors, the present invention saves on transportation and benefits local recycling industry. The light weight of the transported part of the base unit further saves on transportation. Consequently the present invention is beneficial to the environment.

The present invention is further advantageous, since the base does not depend on size of tires, provides broader designer freedom to create a user-friendly and safe base for traffic control devices, it can further accommodate a wide variety of shapes and sizes of posts, delineators and channelizers.

It is an object of the present invention to provide an improved base unit for a traffic delineating device.

It is another object of the present invention to provide more flexibility in the functional design of a base unit for a traffic delineating device.

It is yet another object of the present invention to furnish a base unit for a delineating device with improved anti-rolling features.

In a first aspect, the present invention provides a base unit for a traffic delineating device comprising: a first surface; a second surface; and a side wall connecting the first and second surfaces to define a sleeve for housing ballast; wherein each of the first and second surfaces include an aperture for accepting an end of a body unit.

In a preferred embodiment, the first and the second surfaces are provided with rounded portions and non-rounded portions.

Other aspects and features of the present invention will become apparent to those ordinarily skilled in the art upon review of the following description of specific embodiments of the invention in conjunction with the accompanying Figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a traffic delineating device comprising a base unit and a body unit extending upwardly via a first aperture in the base unit, the base unit comprising a first surface having the first aperture and a second surface having a second aperture, the surfaces being joined together around a substantial section of their perimeters via a side wall, the side wall together with the first surface and the second surface limiting and defining an interior sleeve of the base unit, the side wall further having an opening for inserting ballast between the first and second surfaces into the sleeve, and the ballast being fitted to be held by the sleeve.

Figure 1:
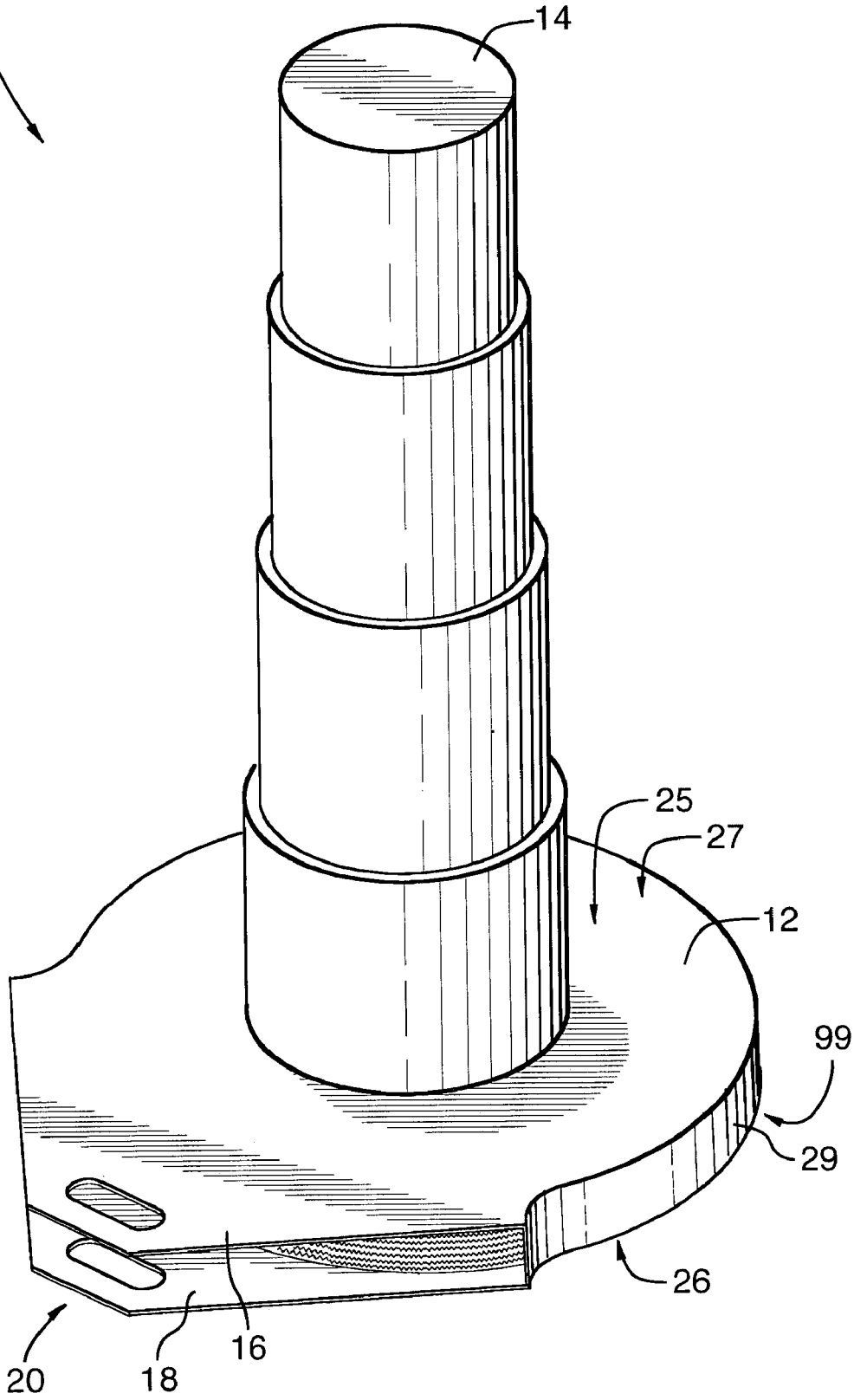
FIG. 1 is a perspective view of a traffic delineating device.

A traffic delineating device 10 is shown in FIG. 1. The traffic delineating device 10 comprises a body unit 14 extending upwardly from an aperture (shown in FIG. 1*a*) in a base unit 12, whereby the base unit is connected with the body unit 14. The base unit 12 comprises a first surface 25 joined along a substantial section of its perimeter to a second surface 26 via a side wall 29. The base unit 12 can be constructed of any suitable weather and impact resistance material, but is preferably a light-weight material such as polyethylene or other plastics. First surface 25 comprises a non-rounded portion 16 and a rounded portion 27, while second surface 26 comprises a non-rounded portion 18 and a rounded portion 99. The material used is preferably flexible enough to enable bending of the first non-rounded portion 16 of the base unit 12 and the second non-rounded portion 18 of the base unit 12 so as to close an opening 20 of the base unit 12.

Figure 1A:
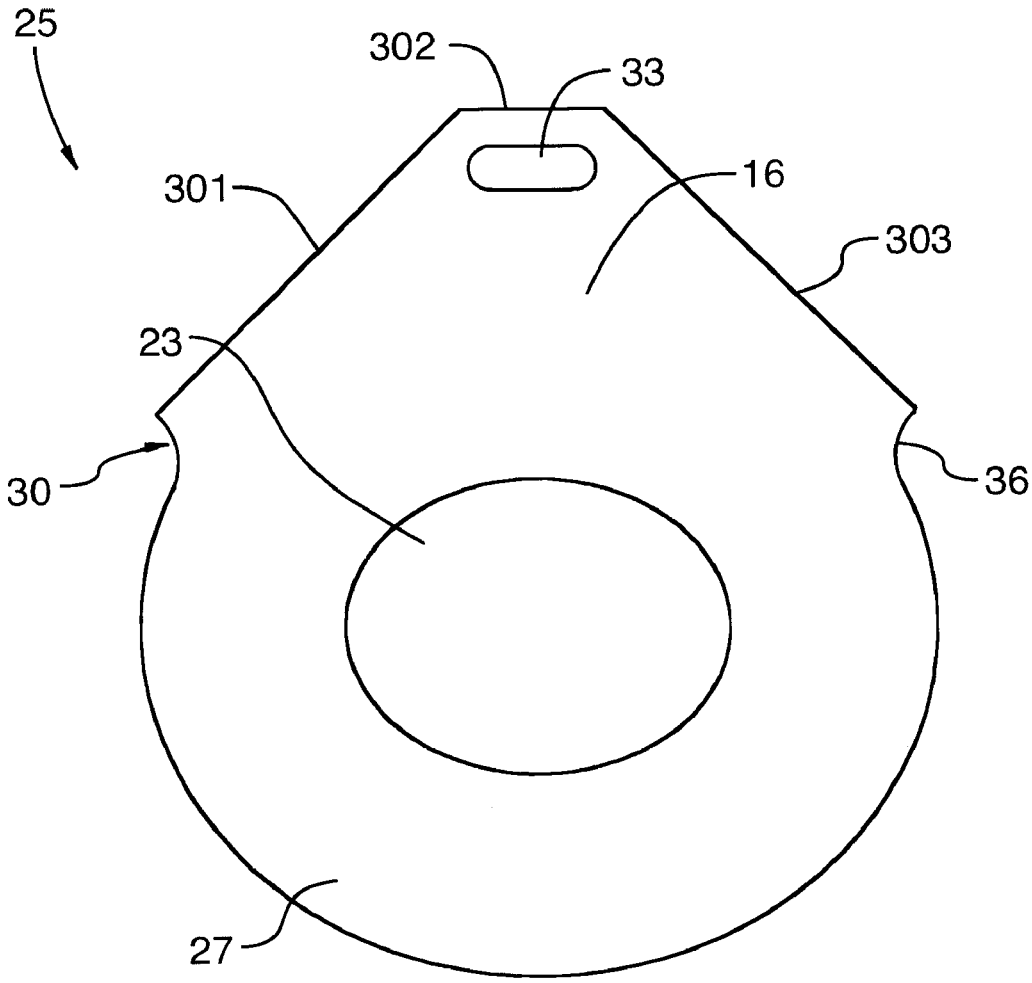
FIG. 1*a* is a top view of a first embodiment of a base unit.

FIG. 1*a* shows the first surface 25 of the base unit 12 and from this Figure an oval aperture 23 can be seen. From FIG. 1*a* it can also be seen that a substantial part of the first surface 25 actually is the rounded portion 27 of the first surface 25 and that the rounded portion 27 is connected to the non-rounded portion 16 of the first surface 25 via two indents 30 and 36 along the edge of the rounded portion 27. The non-rounded portion 16 starting from the indent 30 is not rounded, but has three sides 301, 302, 303 and a fourth side, which fourth side is directly connected to the rounded portion 27. The two sides 301 and 303 together with the fourth side form a shape, which is somewhat triangular, with the fourth side preferably being the longest side and the sides 301 and 303 preferably being of approximately the same length, whereas the side 302 is preferably shorter than the other sides.

Figure 2:
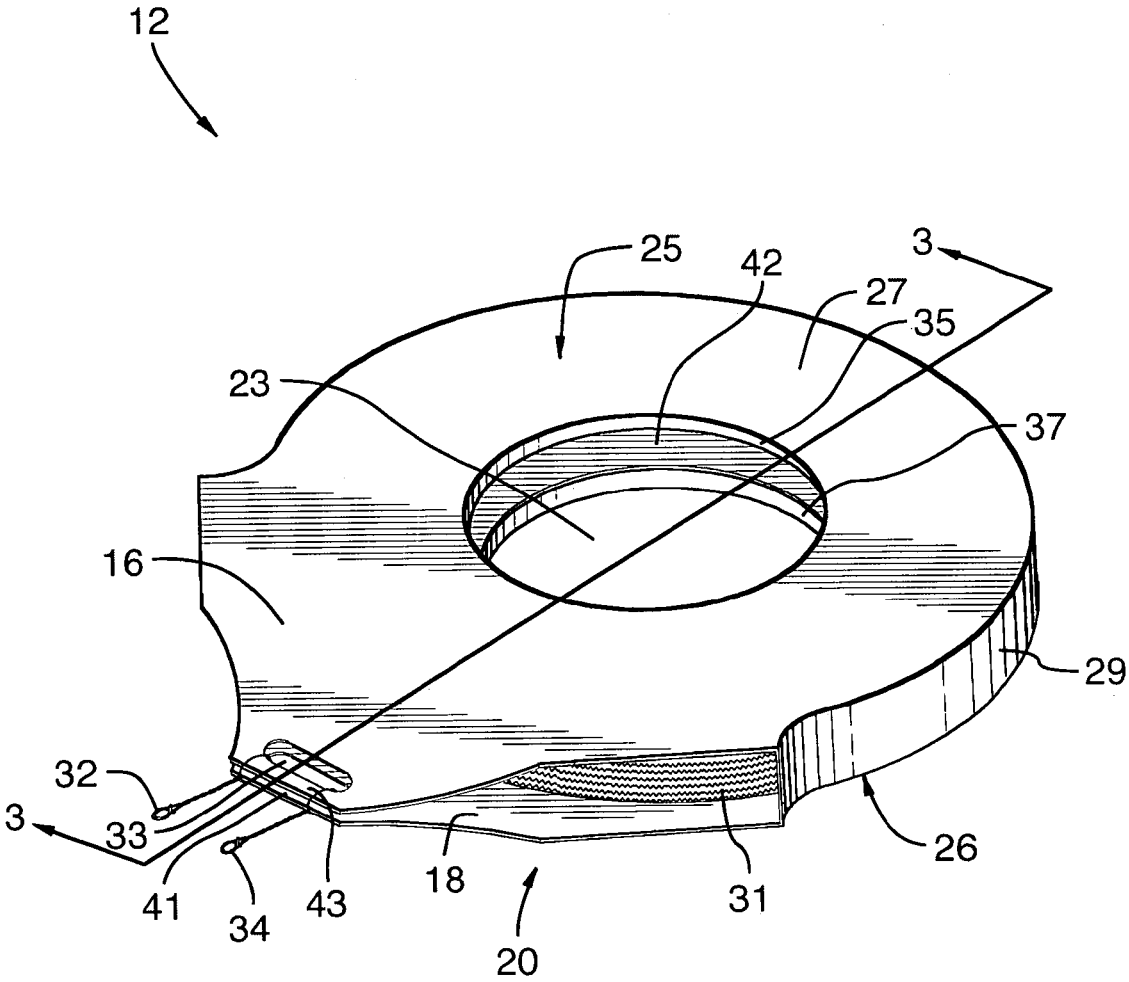
FIG. 2 is a perspective view of the base unit.

Referring now to FIG. 2, the second surface 26 of the base unit is preferably of the same shape and size as the first surface 25. Also an aperture of the second surface 26 is preferably of the same shape and size as the aperture 23 of the first surface 25.

The non-rounded portion 16 can be bound together with the corresponding non-rounded portion 18 of the second surface of the base unit 12 for closing the opening 20, which is for inserting and removing ballast 31. If the opening 20 is closed, the ballast 31 is not likely to slip through the opening 20.

The means for tying the non-rounded portions 16 and 18 together are preferably twisted wires 32 and 34, but any kind of adequate fasteners, such as staples, rivets or wires can be used.

Each non-rounded portion 16 and 18 of the base unit is further provided with handles 41 and 43 for lifting and carrying purposes. The handle 43 is preferably formed by making a hole 33 close to the smallest side 302 in the non-rounded portions 16 and 18 whereby the handle 43 comprises the portions between the smallest side 302 of the non-rounded portion 16 and the hole 33. The handle 41 is formed in the same way by making a hole in the non-rounded portion 18. However, the handles 41 and 43 can be any other type of handle that is designed to be held or operated with the hand. A preferred shape of the hole 33 can be seen from FIG. 2. The hole 33 also assist in tying the non-rounded portions 16 and 18 together, when the opening 20 needs to be closed, since the hole 33 is a hole for the wires 32 and 34, which are put through the hole 33 and around the handle 41 of the second surface 26 and the handle 43, so as to encircle the handles 41 and 43 of both first and second surfaces. The wires 32 and 34 are thereafter twisted together, whereby the opening 20 is closed.

When a traffic delineating device is knocked over it is possible that a round base unit may start to roll like a wheel. In order to prevent the base unit 12 from rolling, the base unit 12 is equipped with an anti-roll feature. The anti-roll feature of the present invention is due to the fact that the base unit comprises a non-rounded portion 16, whereby the non-rounded portion 16 prevents the base unit 12 from rolling, should the device be overturned. In one embodiment the rounded portion 27 of the base unit 12 is not completely round, but rather oval, which makes it even more difficult for the base unit 12 to roll. Also the indents 30 and 36 makes it difficult for the base unit 12 to roll.

From FIG. 2 the central aperture 23 and a first ledge 35 of the first surface 25 and a first ledge 37 of the second surface 26 of the base unit 12 can be seen. The ledge 35 is located along a perimeter of the aperture 23 of the first surface 25 and the ledge 37 is located along a perimeter of the aperture of the second surface 26. The purpose of having the ledges 35 and 37 is to create a contact surface between the body unit 14 and the base unit 12 and to prevent the ballast 31 from sliding through the aperture 23.

Again referring to FIG. 2, the ballast 31 is inserted through the opening 20 into a designated area, which is a sleeve 42, of the base unit 12. The ballast 31 is fitted to be encompassed and held by the sleeve 42. The ballast 31 can also be removed through the opening 20, when ties are removed.

Figure 3:
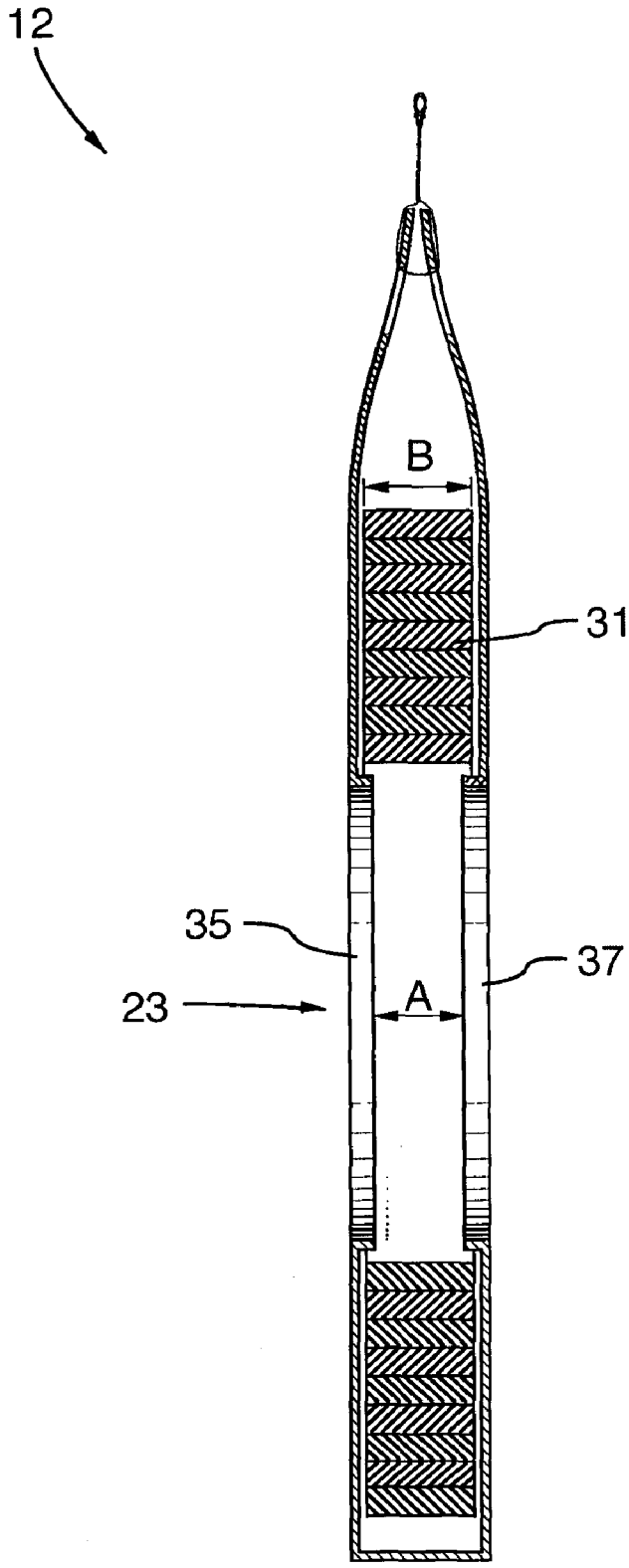
FIG. 3 is a cross-sectional view taken along the line 3—3 of FIG. 2.

FIG. 3 shows the base unit 12 as a cross-sectional side view and from this Figure the ledges 35 and 37 can be more clearly seen.

From FIG. 3 it can also be seen that a distance A between the two ledges 35 and 37 is normally smaller than a width B of the ballast 31, thereby preventing the ballast 31 from sliding through the aperture 23. The ledges 35 and 37 are preferably flexible as to enable the ballast 31 to be easily pushed through, when inserted. However, when the ballast 31 has been put inside the base unit 12 and placed in the sleeve 42, the ballast 31 cannot fall out by itself without force applied.

Figure 4:
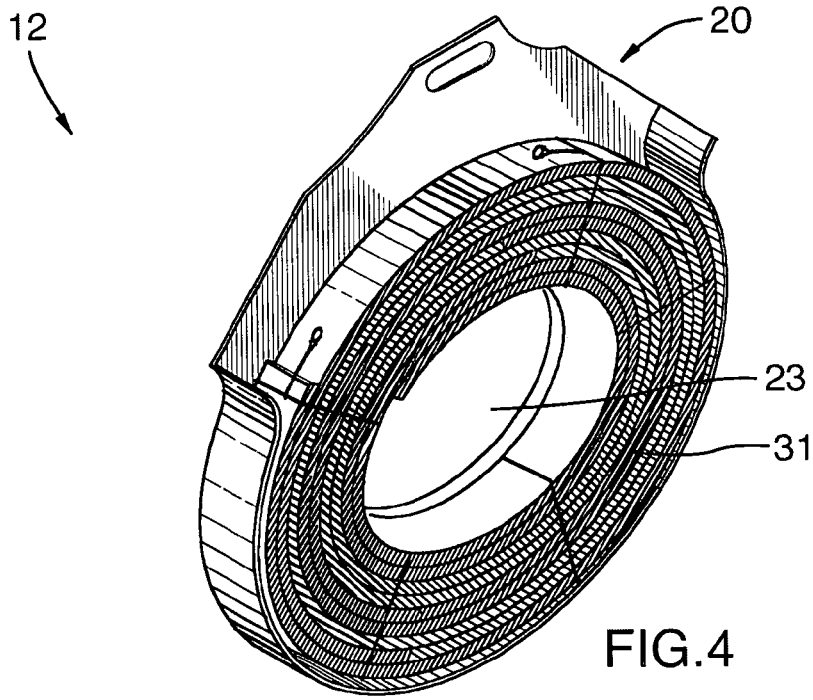
FIG. 4 is a bottom perspective view of the base unit with the bottom portion removed.

FIG. 4 shows a bottom perspective cross-sectional view of the base unit 12. In this figure the ballast 31 is more clearly visible. FIG. 4 shows the sleeve 42, which is surrounded by the side wall 29 and the first surface 25 of the base unit 12.

The aperture 23 is used for the body unit 14 of the traffic delineating device 10, which is fitted into the aperture 23. If the first surface aperture is slightly larger than the aperture for the second surface, the traffic safety feature of the base unit 12 being separable from the body unit 14 in the event of a high impact can be maintained.

Figure 5:
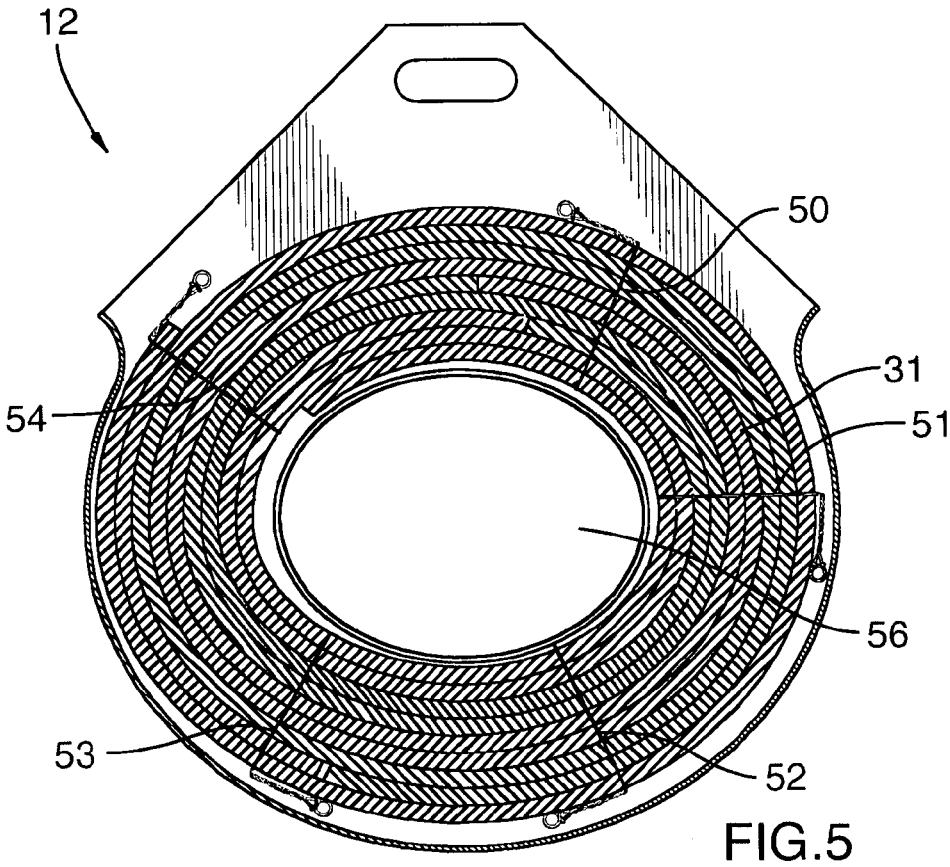
FIG. 5 shows an interior view of the base unit.

Now referring to FIG. 5, the ballast 31 inside of the base unit 12 preferably comprises post-industrial material such as at least one segment of tread from recycled vehicle tires. The ballast 31 is preferably built of flexible stripes, such as the tread portion of recycled rubber, recycled conveyor belts or other flexible, solid, heavy post-industrial non-metal stripes, wound in a cylindrical coil and tied to remain in this shape. The coil-shaped ballast 31 is preferably tied with wires 50, 51, 52, 53 and 54, but any other adequate means for holding the ballast 31 together in a coil-formed shape can be used. The coil-shaped ballast 31 preferably has an aperture 56 to allow passage of the body unit 14 of the traffic delineating device 10 through the ballast 31. The aperture 56 is preferably slightly larger than the aperture 23 so as to ensure that the ballast 31 fits into the base unit 12. The coil-shaped ballast 31 further preferably has an outside diameter, which is larger than the opening 20 of the base unit 12, thereby preventing the ballast 31 from being accidentally extracted once installed, in case the non-rounded portions 16 and 18 are not properly secured. Since the outside diameter of the coil-shaped ballast 31 is larger than the opening 20 of the base unit 12, the ballast 31 has to be squeezed in through the opening 20 to be set in position.

The aperture 56 of the coil-shaped ballast preferably surrounds the ledges 35 and 37 of the apertures in the base unit's first and second surfaces, thereby forming a throughout aperture in the base unit.

Therefore the ballast 31 is preferably round before being inserted into the base unit 12, but when squeezed into the base unit 12, the ledges 35 and 37 limit the ballast's expansion and therefore the ballast 31 will somewhat take the shape of the aperture 23.

For instance, if the aperture 23 has a polygonal shape, the circumference of the ballast's aperture is chosen, by giving the aperture 56 of the cylindrical coil of stripes a certain size when winding, so as to accommodate the polygonal shape of the aperture 23 inside the aperture 56.

Figure 6:
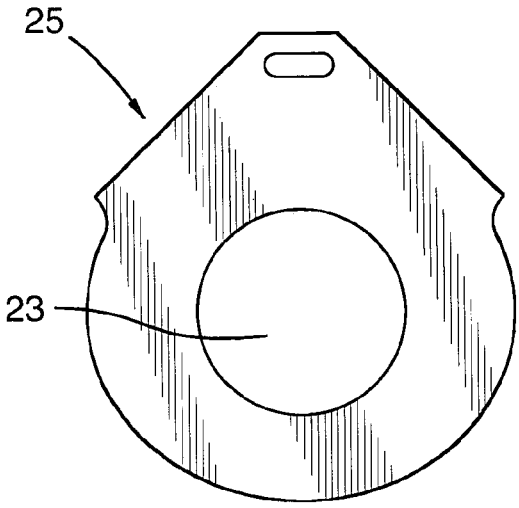
FIG. 6 is a top view of a second embodiment of the invention.
Figure 7:
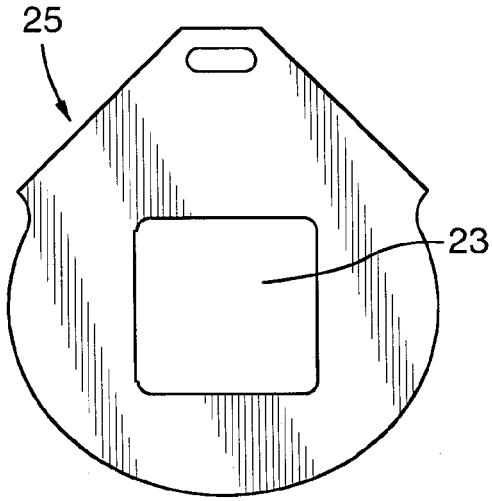
FIG. 7 is a top view of a third embodiment of the invention.
Figure 8:
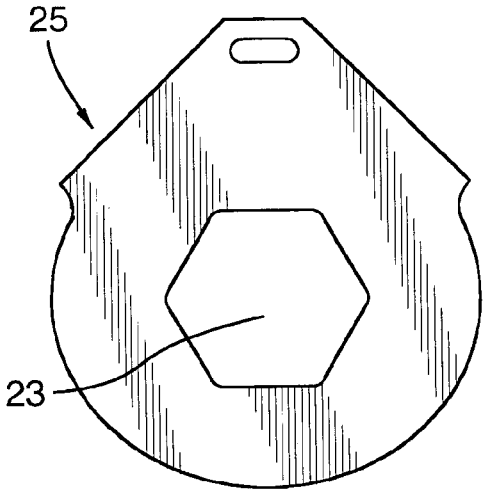
FIG. 8 is a top view of a fourth embodiment of the invention.
Figure 9:
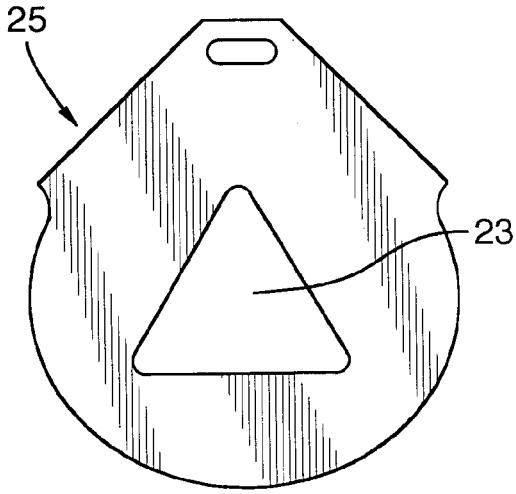
FIG. 9 is a top view of a fifth embodiment of the invention.

FIGS. 6–9 reveal some different shapes that can be used for the aperture 23. FIG. 6 shows the first surface 25 of a base unit 12 with a circular central aperture 23. FIG. 7 shows the first surface 25 of a base unit 12 with a rectangular central aperture 23. FIG. 8 shows the first surface 25 of a base unit 12 with a hexagonal central aperture 23. FIG. 9 shows the first surface 25 of a base unit 12 with a triangular central aperture 23. The aperture 23 can also be square, octagonal or polygonal. Preferably, the corners of the central aperture are rounded, but they may also be left untreated.

Preferably the apertures of the first and second surfaces of the base unit are centrally placed within the first and second surfaces.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A base unit for a traffic delineating device, comprising a molded plastic body, having similarly shaped generally parallel upper and lower surfaces, and an integral outer wall connecting said upper and lower surfaces and extending around more than 180 degrees of an outer periphery of said upper and lower surfaces to space said upper and lower surfaces at a distance B from each other, wherein:

said outer wall extends around not all of said periphery, thereby leaving an opening between said upper and lower surfaces to permit insertion of ballast means into said body;

said upper and lower surfaces each have a similarly shaped generally central hole for said traffic delineating device to project upwardly therethrough, said central holes being generally vertically aligned with each other; and said upper and lower surfaces each have at least one non-round portion extending to said periphery.

2. A base unit as in claim 1, wherein at least one of said upper and lower surfaces has a flange adjacent said central hole, extending partially towards the other of said surfaces, leaving a channel of distance A, where A is less than B, whereby installed ballast having a vertical dimension greater than A will be blocked by said flange(s) against removal, said unit however being sufficiently flexible to permit said ballast to be installed by flexing so that said channel can approximate distance B.

3. A base unit as in claim 1, wherein said upper and lower surfaces are generally circular except at said non-round portion.

4. A base unit as in claim 2, wherein said upper and lower surfaces are generally circular except at said non-round portion.

5. A base unit as in claim 1, wherein said upper and lower surfaces each have a similarly shaped grip hole near said periphery, said holes being generally vertically aligned with each other.

6. A base unit as in claim 2, wherein said upper and lower surfaces each have a similarly shaped grip hole near said periphery, said holes being generally vertically aligned with each other.

7. A base unit as in claim 3, wherein said upper and lower surfaces each have a similarly shaped grip hole near said periphery, said holes being generally vertically aligned with each other.

8. A base unit as in claim 4, wherein said upper and lower surfaces each have a similarly shaped grip hole near said periphery, said holes being generally vertically aligned with each other.

9. A base unit as in claim 1, in combination with said ballast means, wherein said ballast means has a vertical dimension greater than A and not greater than B.

10. A base unit and ballast means combination as in claim 9, wherein said ballast means has an overall width greater than the width of said opening between said upper and lower surfaces to permit insertion of said ballast means into said body, said ballast means being sufficiently flexible to permit insertion nevertheless.

11. A base unit and ballast means combination as in claim 9, wherein said ballast means comprises vehicle tire treads secured together in an annulus shape.

12. A base unit and ballast means combination as in claim 10, wherein said ballast means comprises vehicle tire treads secured together in an annulus shape.

13. A base unit as in claim 1, in combination with said traffic delineating device, said traffic delineating device having a flat base shaped similarly but slightly larger than said central holes, and a delineating portion extending upwardly through said central holes from said flat base.

* * * * *